US009192240B2

(12) United States Patent
Kane

(10) Patent No.: US 9,192,240 B2
(45) Date of Patent: Nov. 24, 2015

(54) RECEPTACLE WITH A POCKET FOR A COLLAPSIBLE CHAIR

(71) Applicant: Melanie Kane, Dorchester, MA (US)

(72) Inventor: Melanie Kane, Dorchester, MA (US)

( * ) Notice: Subject to any disclaimer, the term of this patent is extended or adjusted under 35 U.S.C. 154(b) by 154 days.

(21) Appl. No.: 13/889,054

(22) Filed: May 7, 2013

(65) Prior Publication Data

US 2013/0292976 A1 Nov. 7, 2013

Related U.S. Application Data

(60) Provisional application No. 61/643,779, filed on May 7, 2012, provisional application No. 61/658,342, filed on Jun. 11, 2012.

(51) Int. Cl.
*A47C 7/62* (2006.01)
*A47C 1/14* (2006.01)

(52) U.S. Cl.
CPC .... *A47C 7/62* (2013.01); *A47C 1/14* (2013.01)

(58) Field of Classification Search
CPC ..... A47C 7/62; A47C 1/14
USPC ..... 297/188.08, 188.12, 188.13, 188.2
See application file for complete search history.

(56) References Cited

U.S. PATENT DOCUMENTS 5,354,119 A * 10/1994 Nicholas ..... 297/188.07
5,490,712 A * 2/1996 Drelick ..... 297/188.12
6,000,752 A * 12/1999 Shyr ..... 297/188.13 X
6,053,570 A * 4/2000 Stern et al. ..... 297/188.08 X
7,798,569 B2 * 9/2010 Comarella ..... 297/188.12

* cited by examiner

*Primary Examiner* — Anthony D Barfield
(74) *Attorney, Agent, or Firm* — Fish & Richardson P.C.

(57) ABSTRACT

An apparatus comprising: a sleeve; and a pocket that is coupled to the sleeve; wherein the sleeve is configured to fit around a seat portion of a collapsible chair; wherein the pocket is configured to secure one or more items to the collapsible chair as the chair moves among a plurality of positions.

27 Claims, 7 Drawing Sheets

RECEPTACLE WITH A POCKET FOR A COLLAPSIBLE CHAIR

CLAIM OF PRIORITY

This application claims priority under 35 U.S.C. §119(e) to U.S. patent application Ser. No. 61/643,779, filed on May 7, 2012, and U.S. patent application Ser. No. 61/658,342, filed on Jun. 11, 2012, the entire contents of each of which are incorporated herein by reference.

TECHNICAL FIELD

This invention relates to receptacle that fits around a collapsible chair, e.g., for storage of items.

BACKGROUND

Generally, stadium chairs are collapsible chairs. In this example, a collapsible chair includes a chair in which the seat portion of the chair changes positions, e.g., based on whether a person is sitting in the chair or has stood up. For example, as a person stands up, the seat portion of the collapsible chair moves in an upward, vertical direction. As a person sits in the collapsible chair, the seat portion moves in downward, vertical direct. The periodic movement of the seat portion of the chair, e.g., as a person stands up and sits down, prevents an individual from placing items (e.g., a purse, a backpack, and so forth) in a secure position on the collapsible chair. For example, as a person stands up from the collapsible chair, the upward, vertical motion of the seat will displace (e.g., knock off) personal items that were previously placed on the seat portion.

SUMMARY

In one aspect of the present disclosure, an apparatus includes a sleeve; and a pocket that is coupled to the sleeve; wherein the sleeve is configured to fit around a seat portion of a collapsible chair; wherein the pocket is configured to secure one or more items to the collapsible chair as the chair moves among a plurality of positions.

Implementations of the disclosure can include one or more of the following features. In some implementations, the plurality of positions comprise at least a first, upward position and a second, downward position. In other implementations, the pocket comprises an opening for placement of the one or more items. In still other implementations, the apparatus includes a closure mechanism that is affixed to the pocket and configured to move from a first position to a second position to close the opening.

In another aspect of the present disclosure, a portable, under-seat storage apparatus includes an open-ended sleeve made of an elastic fabric for sliding over a seat portion of a collapsible chair to secure the portable, under-seat storage apparatus around a width of the seat portion; wherein the open-ended sleeve comprises a first opening and a second opening; wherein the first and second openings promote fitting the portable, under-seat storage apparatus over the seat portion of the collapsible chair; a first elastic band material that is affixed to a circumference of the first opening of the open-ended sleeve to promote the open-ended sleeve remaining securely affixed to the seat portion while the seat portion moves among a lowered position and a raised position; a second elastic band material that is affixed to a circumference of the second opening of the open-ended sleeve to promote the open-ended sleeve remaining securely affixed to the seat portion while the seat portion moves among a lowered position and a raised position; an elastic trim for securing an elastic fabric pocket to the open-ended sleeve with an elastic trim; an elastic fabric pocket that is attached to the underside of the open-ended sleeve by the elastic trim; wherein the elastic fabric pocket is configured to hang down from the underside of the seat portion when the seat portion is in the lowered position; wherein the elastic fabric pocket is further configured to remain affixed to the seat portion when the seat portion moves to the raised position; and a closure mechanism for securing one or more personal items in the elastic mesh fabric pocket.

Implementations of the disclosure can include one or more of the following features. In some implementations, the portable, under-seat storage apparatus further includes a pouch that is attached to a seam of the open-ended sleeve; wherein the pouch is configured to hold the open-ended sleeve in a collapsed position and the elastic fabric pocket in a collapsed position. In still other implementations, the portable, under-seat storage apparatus further includes a drawstring closure to secure the open-ended sleeve and the elastic fabric pocket in the pouch.

In yet other implementations, the open-ended sleeve is an elastic band for affixing the portable, under-seat storage apparatus to the seat portion. In other implementations, the portable, under-seat storage apparatus further includes when the seat portion of the collapsible chair is in the raised position and when a user of the portable, under-seat storage apparatus is not sitting in the collapsible chair: the elastic fabric pocket is further configured to remain affixed to the seat portion and to hold the one or more personal items placed in the elastic mesh fabric pocket. In still other implementations, the portable, under-seat storage apparatus further includes when the seat portion of the collapsible chair is in a lower position in which a user of the portable, under-seat storage apparatus is sitting in the collapsible chair: the elastic fabric pocket is further configured to remain affixed to the seat portion and to hold the one or more personal items placed in the elastic mesh fabric pocket.

In yet other implementations, the collapsible chair comprises a stadium chair. In still other implementations, a width of the open-ended sleeve is in accordance with a width of the seat portion of the collapsible chair; a length of the open-ended sleeve is in accordance with a length of the seat portion of the collapsible chair; a width of the elastic fabric pocket is in accordance with the width of the open-ended sleeve; and a length of the elastic fabric pocket is in accordance with the length of the open-ended sleeve. In still other implementations, a width of the open-ended sleeve is substantially the same as a width of the seat portion of the collapsible chair; a length of the open-ended sleeve is substantially the same as a length of the seat portion of the collapsible chair; a width of the elastic fabric pocket is substantially the same as the width of the open-ended sleeve; and a length of the elastic fabric pocket is substantially the same as the length of the open-ended sleeve.

In yet another implementation, the elastic trim affixes the open-ended sleeve to the elastic fabric pocket by: affixing an upper end of the open-ended sleeve to an upper end of the elastic mesh fabric pocket; affixing a lower end of the open-ended sleeve to a lower end of the elastic mesh fabric pocket; affixing a right-most side of the open-ended sleeve to a right-most side of the elastic mesh fabric pocket; and affixing a left-most side of the open-ended sleeve to a left-most side of the elastic mesh fabric pocket. In still another implementations, the open-ended sleeve is configured to expand along one or more dimensions to accommodate a size of the seat portion of the collapsible chair. In still another implementation, the elastic fabric pocket is configured to expand along one or more dimensions to accommodate a size of the one or more personal items that are placed in the elastic mesh fabric pocket. In yet another implementation, a center of the open-ended sleeve is hollow to promote fitting of the open-ended sleeve around the seat portion of the collapsible chair.

In still another implementation, the open-ended sleeve comprises a first arm structure and a second arm structure, wherein an arm structure comprises a portion of the open-ended sleeve that is secured against a side of the seat portion of the collapsible chair. In yet another implementation, the elastic fabric pocket comprises an open end and a closed end.

The details of one or more implementations are set forth in the accompanying drawings and the description below. Other features, objects, and advantages will be apparent from the description and drawings, and from the claims.

DETAILED DESCRIPTION

Figure 1A:
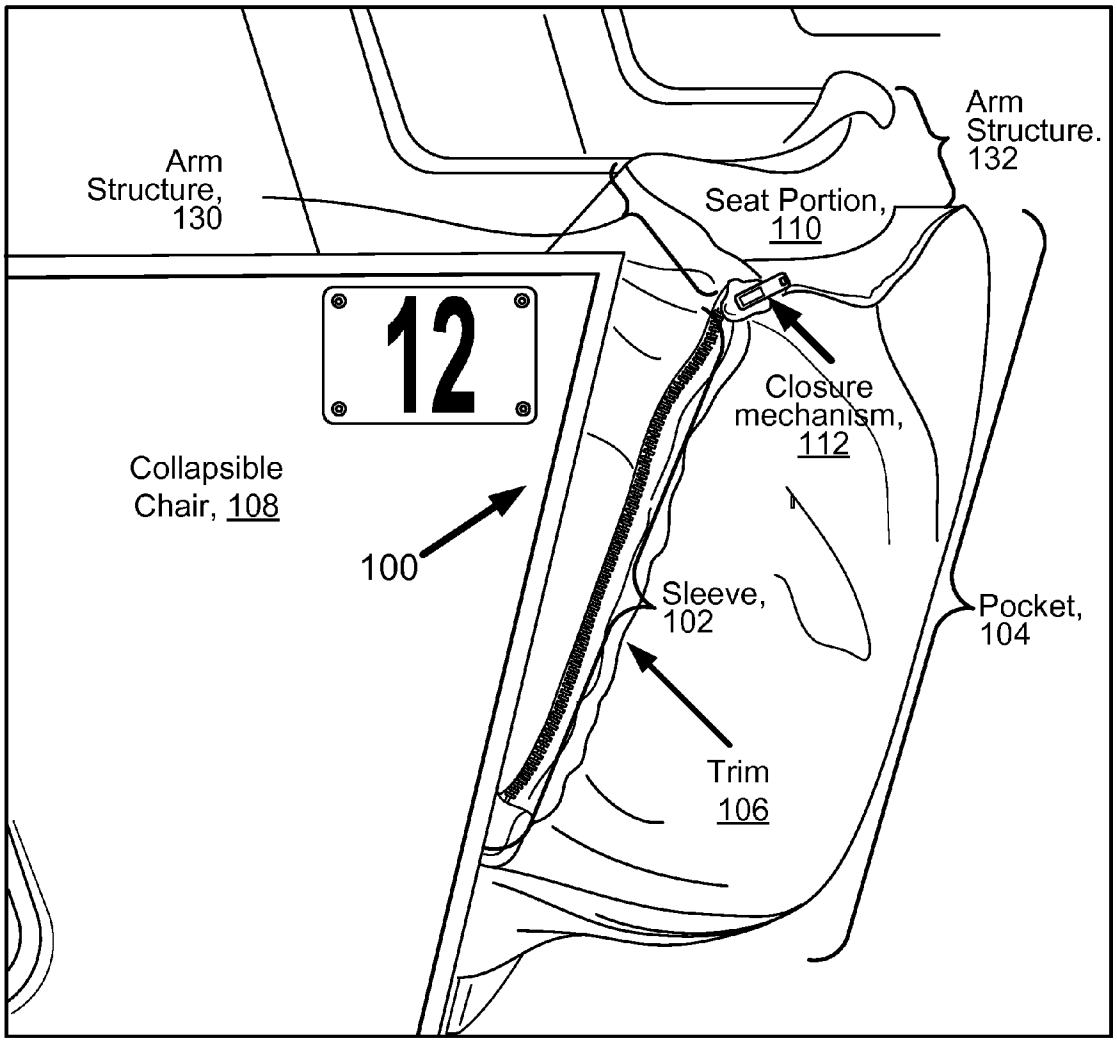
FIGS. 1A and 2 are photographs of the receptacle on a collapsible chair.

Referring to FIG. 1A, receptacle 100 is shown for the secure placement and storage or items (e.g., personal items) on a collapsible chair. Receptacle 100 includes a portable, under-seat storage apparatus. In the illustrated embodiment, receptacle 100 includes sleeve 102, pocket 104, trim 106 and a closure mechanism 112 (e.g., a zipper). Sleeve 102 includes an open-ended sleeve made of an elastic fabric that slides over seat portion 110 (e.g., a folding seat) of a collapsible chair 108 to secure receptacle 100 around the width of the seat portion 110.

Pocket 104 may include elastic mesh fabric and is attached to the underside of the sleeve 102, securing the pocket 104 to the sleeve 102 with an elastic trim 106. Pocket 104 may be fabricated from various fabrics, including, e.g., nylon, spandex and so forth.

In the illustrated example of FIG. 1A, the dimensions of pocket 104 are substantially equal to the dimensions of the bottom of the sleeve 102. The pocket 14 hangs down from the underside of the seat portion 110. At the opening of the pocket 104 is a closure mechanism 112 that promotes securing personal items inside the pocket 104.

In an example, two individual elastic bands are sewn into the circumferences of the openings in sleeve 102 to keep the sleeve 102 securely affixed to the seat portion 110 while the seat portion 110 is lowered and raised. In this example, sleeve 102 may be made of an elastic material to promote a secure coupling between sleeve 102 and seat portion 110. In this example, sleeve 102 acts an elastic band to affix receptacle 100 to seat portion 110.

In the example of FIG. 1A, seat portion 110 is in an upright position. In this example, pocket 104 holds numerous personal items and closure mechanism 112 is used to close an opening in pocket 104, e.g., such that the personal items remain in pocket 104 as seat portion 110 moves from an upward position to a downward position and vice versa. In the illustrative example of FIG. 1A, sleeve 102 is affixed to pocket 104 via trim 106.

Receptacle 100 is configured to fit around seat portion 110. In the example of FIG. 1A, sleeve 102 is affixed to a top portion of seat portion 110 and pocket 104 hangs beneath the bottom of seat portion 110. Because pocket 104 is affixed to sleeve 102 and sleeve 102 is configured to be secured to seat portion 110, pocket 104 is also secured to seat portion 110.

In an example, sleeve 102 is a separate component from pocket 104. In this example, the component of sleeve 102 is affixed to the component of pocket 104, e.g., via trim 106. In another example, sleeve 102 and pocket 104 share a common side. In this example, the portion of sleeve 102 that rests on the bottom portion of seat portion 110 is also port of pocket 104. That is, the top portion of pocket 104 and the bottom portion of sleeve 102 may be the same.

Figure 1B:
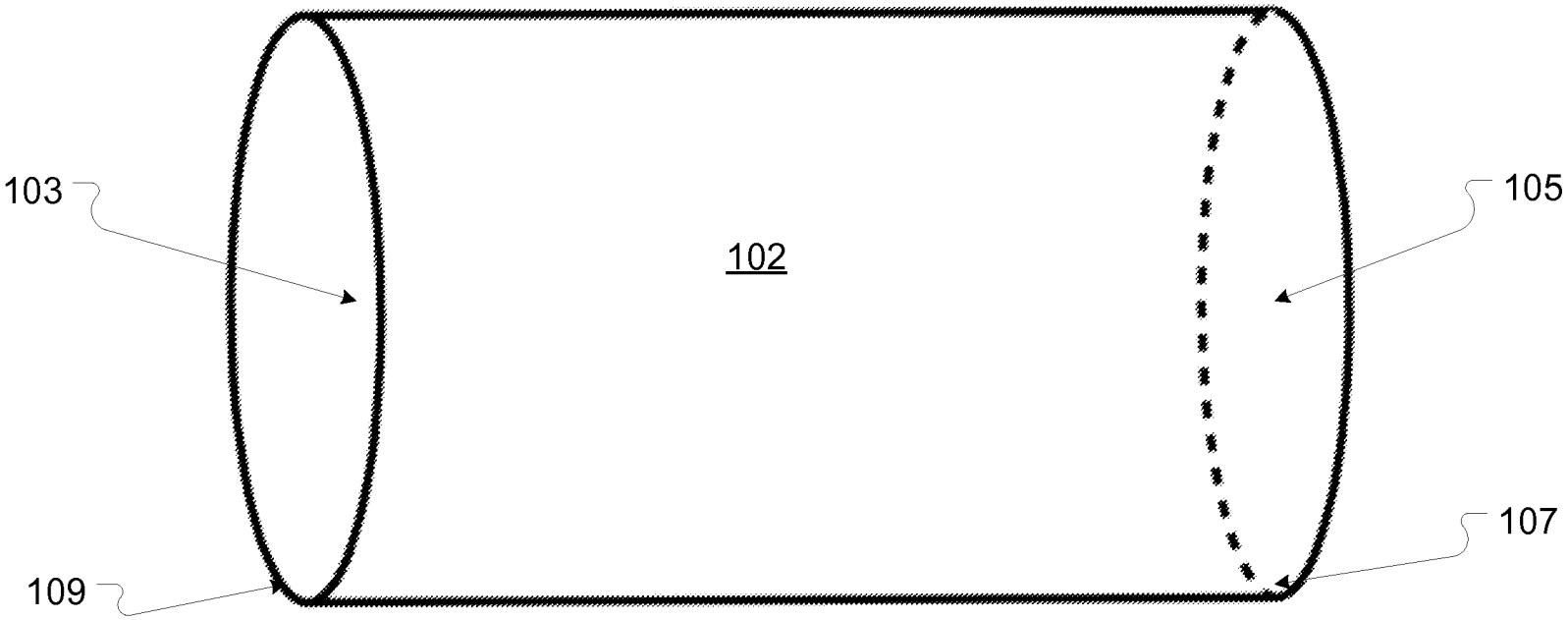
FIG. 1B is a diagram of a sleeve portion of the receptacle.

Referring to FIG. 1B, sleeve 102 is an open-ended sleeve and includes openings 103, 105. In this example, opening 103 is associated with circumference 109. Opening 105 is associated with circumference 107. Sleeve 102 includes an elastic band material that is affixed to at least part of circumference 109 of opening 103 of the open-ended sleeve 103 to promote the sleeve 102 being securely affixed to the seat portion 110 (FIG. 1A) while the seat portion 110 moves among a lowered position and a raised position.

In the example of FIG. 1B, an elastic band material is also affixed to (e.g., sewn into) at least part of circumference 107 of opening 105 of the sleeve 102 to promote the sleeve 102 remaining securely affixed to the seat portion 110 while the seat portion 110 moves among a lowered position and a raised position. In this example, opening 103 is in proximity to opening 107 (FIG. 1C) in receptacle 100 (e.g., opening 103 is on the pocket side of receptacle 100). In this example, the elastic band material is sewn into a portion of circumference 109 such that part of circumference 109 includes the elastic band material and another part of circumference 109 includes closure mechanism 112. In this example, a center of sleeve 102 is hollow to promote fitting of sleeve 102 around seat portion 104 of the collapsible chair. In this example, opening 103 extends to opening 105, e.g., such that the middle portions of open-ended sleeve are also open.

Figure 1C:
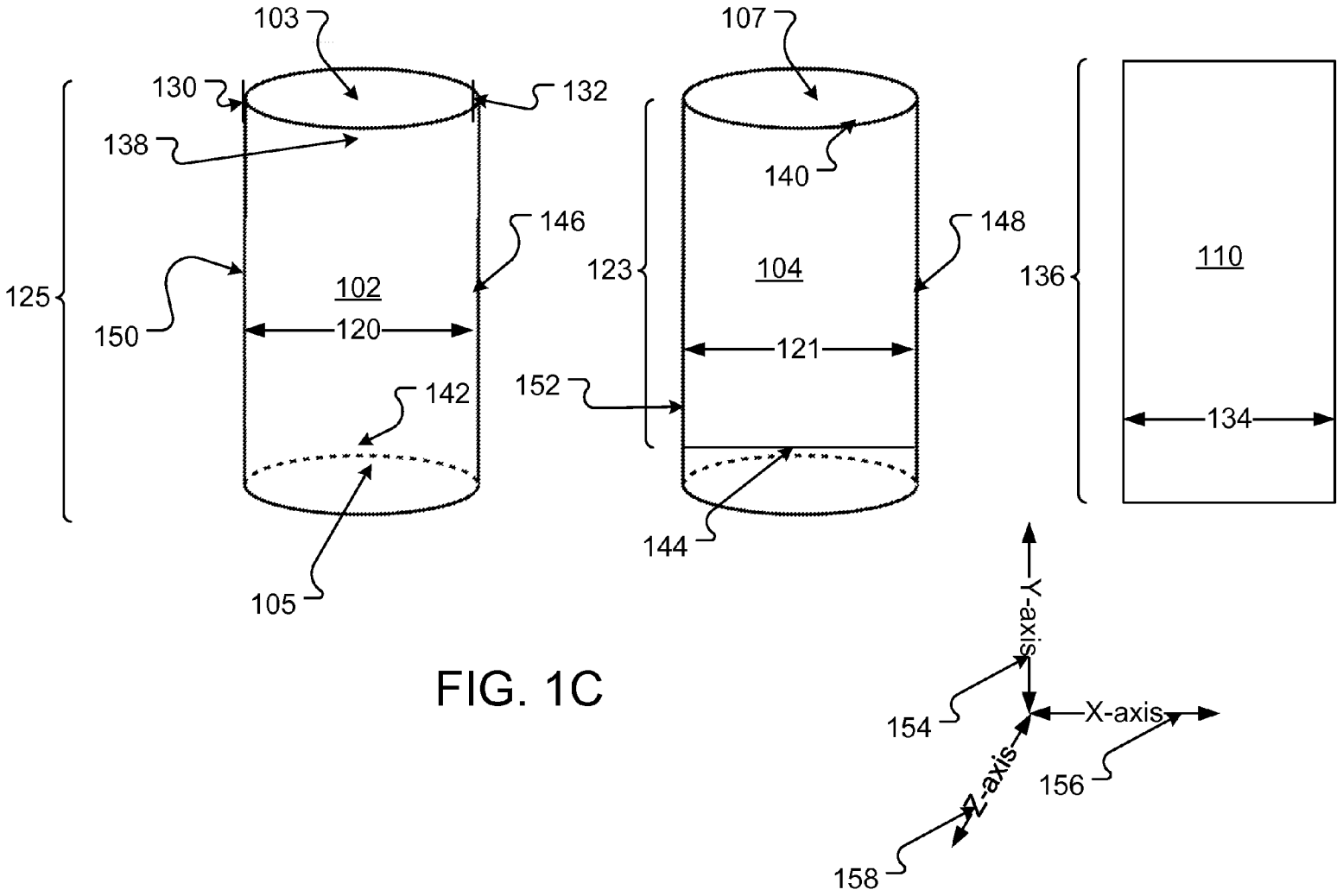
FIG. 1C is a diagram of the sleeve portion of the receptacle and the pocket portion of the receptacle.

Referring to FIG. 1C, receptacle 100 is a portable under-seat storage apparatus that includes sleeve 102 and pocket 104 (e.g., an elastic mesh fabric pocket). In this example, pocket 104 is an elastic band for affixing portable, under-seat storage apparatus 100 to seat portion 110. In this example, when seat portion 110 of the collapsible chair is in the raised position and when a user of portable, under-seat storage apparatus 100 is not sitting in the collapsible chair: pocket 104 is further configured to remain affixed to seat portion 110 and to hold the one or more personal items placed in the pocket 104. In another example, when seat portion 110 of the collapsible chair is in a lower position in which a user of portable, under-seat storage apparatus 100 is sitting in the collapsible chair: pocket 104 is further configured to remain affixed to seat portion 110 and to hold the one or more personal items placed in pocket 104.

In the example of FIG. 1C, sleeve 102 has width 120 and length 125. In this example, width 120 of sleeve 102 is in accordance with width 134 of seat portion 110 of the collapsible chair. Length 125 of open-ended sleeve 104 is in accordance with length 136 of seat portion 110 of the collapsible chair. Pocket 104 has width 121 and length 123. Width 121 of the pocket 104 is in accordance with width 120 of sleeve 102 and with width 134 of seat portion 110 of the collapsible chair. Length 123 of pocket 104 is in accordance with length 125 of sleeve 102 and with length 136 of seat portion 110 of the collapsible chair. In another example, width 120 of sleeve 102 is substantially the same as width 134 of seat portion 110 of the collapsible chair. Length 125 of open-ended sleeve 104 is substantially the same as length 136 of seat portion 110 of the collapsible chair. Width 121 of the pocket 104 is substantially the same as width 120 of sleeve 102 and substantially the same as width 134 of seat portion 110 of the collapsible chair. Length 123 of pocket 104 is substantially the same as length 125 of sleeve 102 and substantially the same as length 136 of seat portion 110 of the collapsible chair In this example, trim 106 (FIG. 1A) affixes sleeve 102 to pocket 104 by: affixing (e.g., sewing together) upper end 138 of sleeve 102 to upper end 140 of pocket 104, affixing lower end 142 of sleeve 102 to lower end 144 of pocket 104, affixing right-most side 146 of sleeve 102 to right-most side 148 of elastic fabric pocket 102, and affixing left-most side 150 of sleeve 102 to left-most side 152 of pocket 104.

In the example of FIG. 1C, sleeve 102 is configured to expand along one or more dimensions in an x-plane 156, in a y-plane 154 and/or in a z-plane 158 to accommodate a size of seat portion 110 of the collapsible chair. In this example, pocket 104 is configured to expand along one or more dimensions in an x-plane 156, in a y-plane 154 and/or in a z-plane 158 to accommodate a size of the one or more personal items that are placed in pocket 104. In this example, open-ended sleeve comprises first arm structure 130 and second arm structure 132, which are also shown in FIG. 1A. In this example, an arm structure comprises a portion of sleeve 102 that is secured against a side (as opposed to the top or the bottom) of seat portion 110 of the collapsible chair. Arm structures 130, 132 provide support for pocket 104 and promote secure affixation of pocket 104 relative to sleeve 102. In this example, arm structures 130, 132 are part of a dimension of sleeve 102 in the z-axis. Arm structures 130, 132 are made of elastic material and are configured to expand along one or more dimensions in an x-plane 156, in a y-plane 154 and/or in a z-plane 158 to accommodate a width of seat portion 110 of the collapsible chair. In this example, pocket 104 includes open end 107 and closed end 144. In this example, a user of receptacle 100 places one or more personal items into open end 107 of pocket 104.

Figure 2:
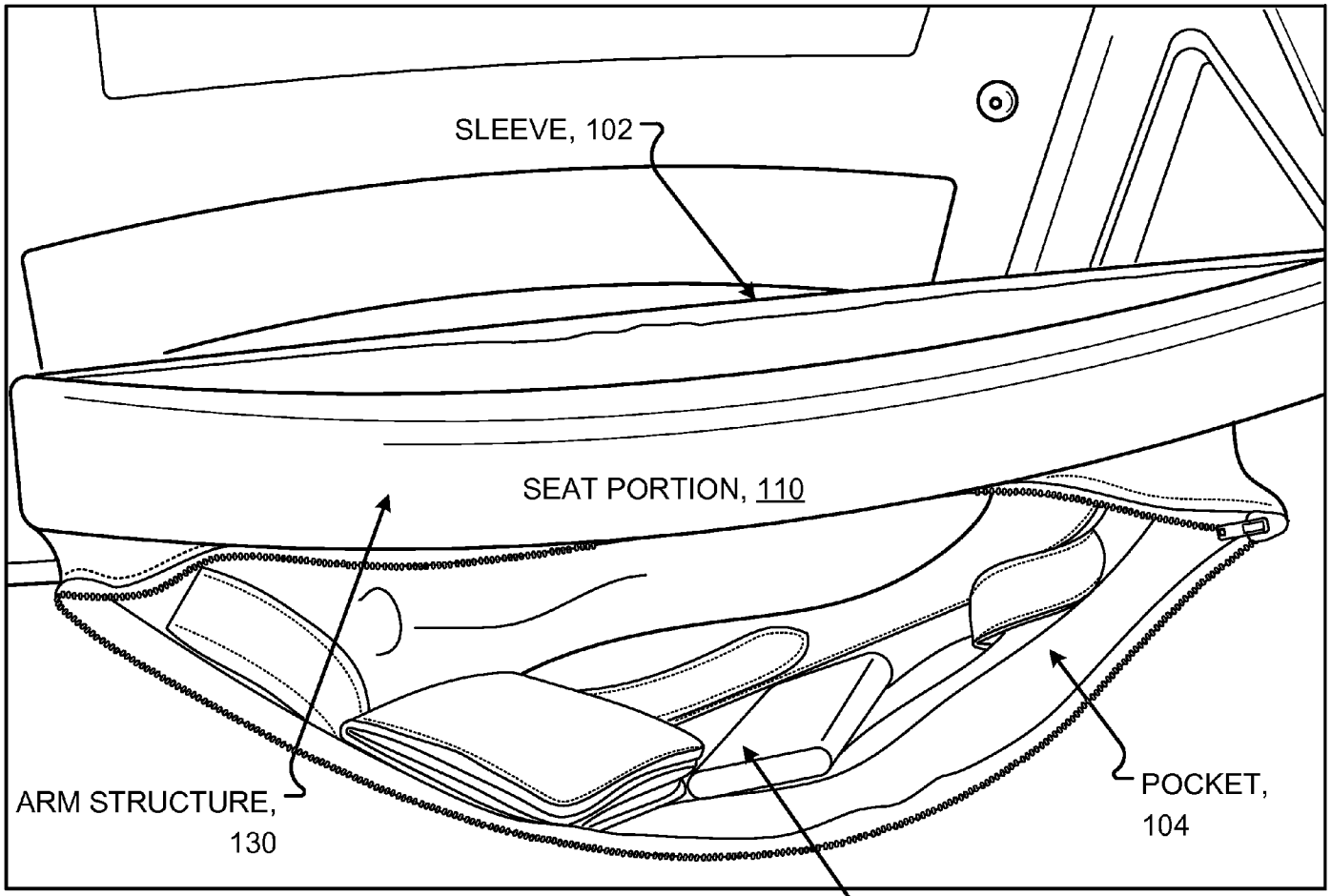

Referring to FIG. 2, seat portion 110 is in a downward position. In this example, closure mechanism 112 is in a position in which pocket 104 is open. In the illustrative example of FIG. 2, pocket 104 includes numerous personal items 101, including, e.g., car keys, wallet, purse, etc. As closure mechanism 112 moves from a first position to a second position, closure mechanism 112 closes the opening of pocket 104, thereby securing the contents of pocket 104.

In another example, receptacle 100 includes a loop (e.g., an elastic loop) so a consumer can fold up the receptacle 100 and wrap the loop around it so that the receptacle is contained, e.g., similar to the way one closes up an umbrella.

Figure 3:
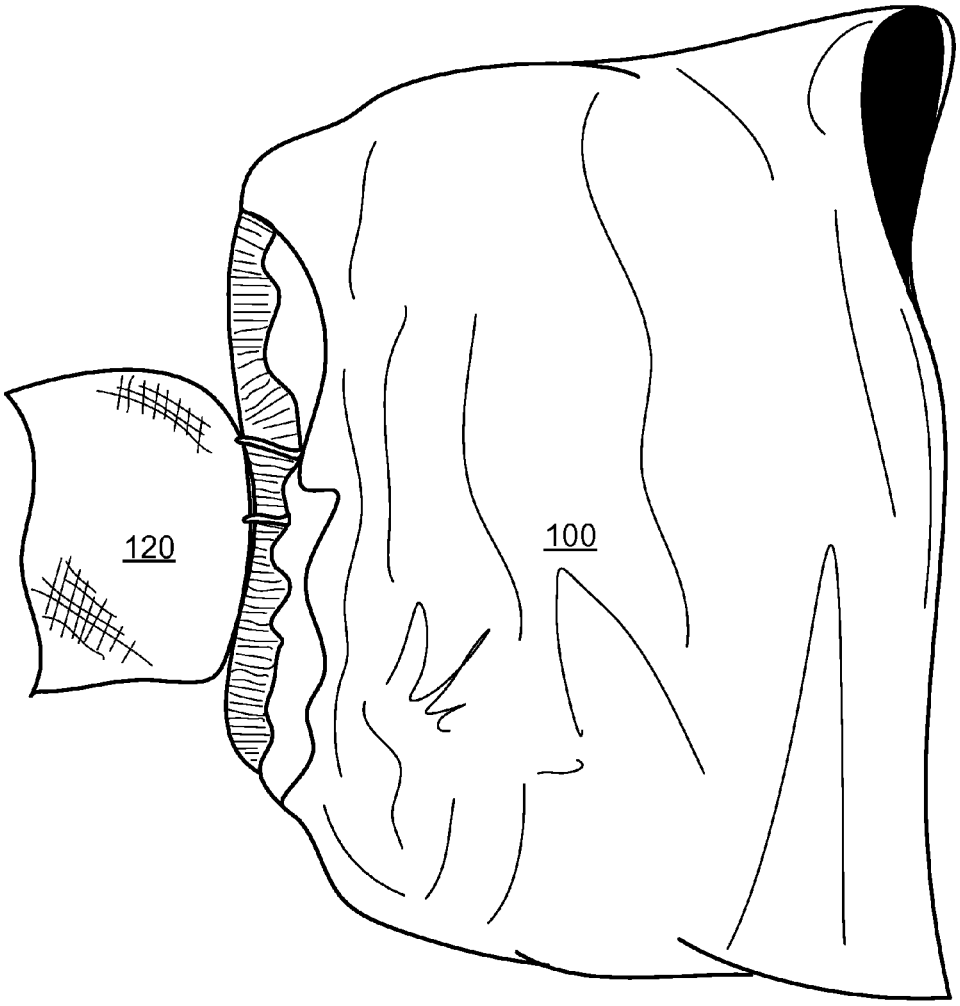
FIGS. 3, 4 and 5 are photographs of the receptacle with a pouch. Like reference symbols in the various drawings indicate like elements.

Referring to FIG. 3, receptacle 100 is connected to a holder, e.g., pouch 120. In an example, pouch receptacle 100 includes pouch 120. In this example, pouch 120 is sewn into the seam of the rear side of sleeve 102. Using pouch 120, a user of receptacle 100 can roll receptacle 100 into a ball and then fold it into the pouch 120 for storage. In this example, since pouch 120 is sewed to the receptacle 100, the user does not have to keep track of where the pouch 120 is, or worry about losing pouch 120. In an example, pouch 120 includes a drawstring closure to further secure the receptacle 100 in the pouch 120. In this example, pouch 120 is configured to hold sleeve 102 in a collapsed position and the pocket 104 in a collapsed position. Generally, a collapsed position includes a position in which the dimensions of the receptacle 100 consumer a decreased amount of space, e.g., relative to the amount of space consumed by the dimensions of the receptacle 100 in other positions. In this example, pouch 120 includes a drawstring closure to secure the sleeve 102 and the pocket 104 in the pouch 120

Figure 4:
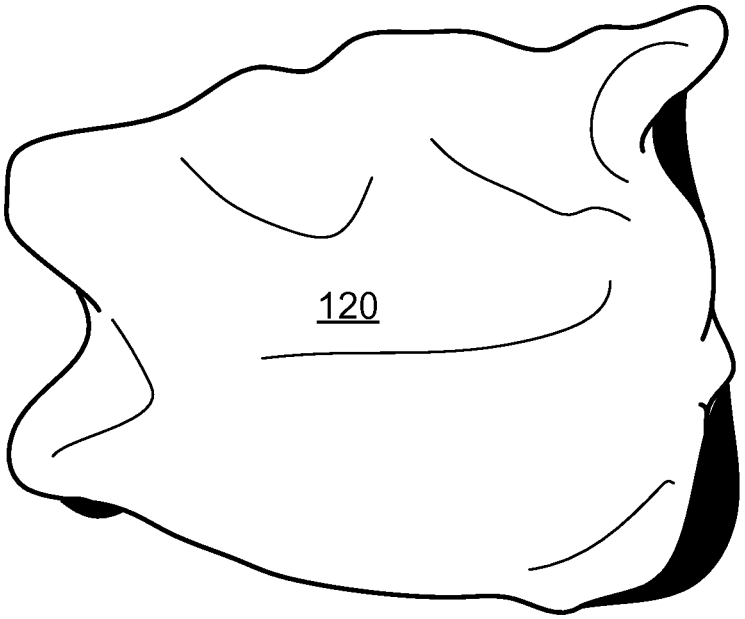
Figure 5:
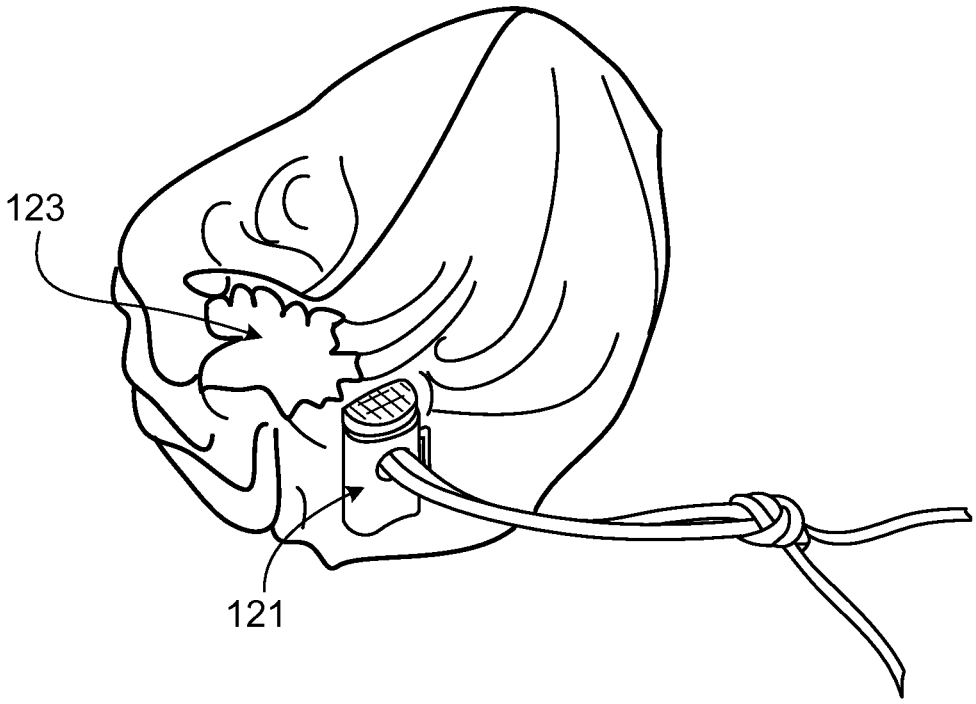

Referring to FIG. 4, receptacle 100 has been folded into pouch 120, e.g., such that receptacle 100 is not visible FIG. 4. Referring to FIG. 5, pouch 120 includes cord stopper 121, e.g., to close opening 123 which is included in pouch 120.

A number of embodiments of the invention have been described. Nevertheless, it will be understood that various modifications may be made without departing from the spirit and scope of the invention. For example, the components described herein made be made from fabric, elastic, and so forth. Accordingly, other embodiments are within the scope of the following claims.

What is claimed is:

1. A portable, under-seat storage apparatus comprising:

an open-ended sleeve made of an elastic fabric for sliding over a seat portion of a collapsible chair to secure the portable, under-seat storage apparatus around the seat portion;

wherein the open-ended sleeve comprises a first opening at one end of the open-ended sleeve, a second opening at another end of the open-ended sleeve and is open in the middle;

wherein the first and second openings promote fitting the portable, under-seat storage apparatus over the seat portion of the collapsible chair;

a first elastic band material that is affixed to at least part of a circumference of the first opening of the open-ended sleeve to promote the open-ended sleeve remaining securely affixed to the seat portion while the seat portion moves among a lowered position and a raised position;

a second elastic band material that is affixed to at least part of a circumference of the second opening of the open-ended sleeve to promote the open-ended sleeve remaining securely affixed to the seat portion while the seat portion moves among a lowered position and a raised position;

an elastic trim for securing an elastic fabric pocket to the open-ended sleeve with an elastic trim;

the elastic fabric pocket that is attached to the underside of the open-ended sleeve by the elastic trim;

wherein the elastic fabric pocket is configured to hang down from the underside of the seat portion when the seat portion is in the lowered position;

wherein the elastic fabric pocket is further configured to remain affixed to the seat portion when the seat portion moves to the raised position;

a closure mechanism for securing one or more personal items in the elastic fabric pocket;

a pouch that is attached to a seam of the open-ended sleeve;

wherein the pouch is configured to hold the open-ended sleeve in a collapsed position and the elastic fabric pocket in a collapsed position; and a drawstring closure to secure the open-ended sleeve and the elastic fabric pocket in the pouch.

2. The portable, under-seat storage apparatus of claim 1, wherein the open-ended sleeve is an elastic band for affixing the portable, under-seat storage apparatus to the seat portion.

3. The portable, under-seat storage apparatus of claim 1, further comprising:

when the seat portion of the collapsible chair is in the raised position and when a user of the portable, under-seat storage apparatus is not sitting in the collapsible chair:

the elastic fabric pocket is further configured to remain affixed to the seat portion and to hold the one or more personal items placed in the elastic fabric pocket.

4. The portable, under-seat storage apparatus of claim 1, further comprising:

when the seat portion of the collapsible chair is in a lower position in which a user of the portable, under-seat storage apparatus is sitting in the collapsible chair:

the elastic fabric pocket is further configured to remain affixed to the seat portion and to hold the one or more personal items placed in the elastic mesh fabric pocket.

5. The portable, under-seat storage apparatus of claim 1, wherein the collapsible chair comprises a stadium chair.

6. The portable, under-seat storage apparatus of claim 1, wherein:

a width of the elastic fabric pocket is in accordance with the width of the open-ended sleeve; and a length of the elastic fabric pocket is in accordance with the length of the open-ended sleeve.

7. The portable, under-seat storage apparatus of claim 1, wherein:

a width of the elastic fabric pocket is substantially the same as the width of the open-ended sleeve; and a length of the elastic fabric pocket is substantially the same as the length of the open-ended sleeve.

8. The portable, under-seat storage apparatus of claim 1, wherein:

the elastic trim affixes the open-ended sleeve to the elastic fabric pocket by:

affixing an upper end of the open-ended sleeve to an upper end of the elastic fabric pocket;

affixing a lower end of the open-ended sleeve to a lower end of the elastic fabric pocket;

affixing a right-most side of the open-ended sleeve to a right-most side of the elastic fabric pocket; and affixing a left-most side of the open-ended sleeve to a left-most side of the elastic fabric pocket.

9. The portable, under-seat storage apparatus of claim 1, wherein the open-ended sleeve is configured to expand along one or more dimensions to accommodate a size of the seat portion of the collapsible chair.

10. The portable, under-seat storage apparatus of claim 1, wherein the elastic fabric pocket is configured to expand along one or more dimensions to accommodate a size of the one or more personal items that are placed in the elastic fabric pocket.

11. The portable, under-seat storage apparatus of claim 1, wherein a center of the open-ended sleeve is hollow to promote fitting of the open-ended sleeve around the seat portion of the collapsible chair.

12. The portable, under-seat storage apparatus of claim 1, wherein the open-ended sleeve comprises a first arm structure and a second arm structure, wherein an arm structure comprises a portion of the open-ended sleeve that is secured against a side of the seat portion of the collapsible chair.

13. The portable, under-seat storage apparatus of claim 1, wherein the elastic fabric pocket comprises an open end and a closed end.

14. A portable, under-seat storage apparatus comprising:

an open-ended sleeve made of an elastic fabric for sliding over a seat portion of a collapsible chair to secure the portable, under-seat storage apparatus around the seat portion;

wherein the open-ended sleeve comprises a first opening at one end of the open-ended sleeve, a second opening at another end of the open-ended sleeve and is open in the middle;

wherein the first and second openings promote fitting the portable, under-seat storage apparatus over the seat portion of the collapsible chair;

a first elastic band material that is affixed to at least part of a circumference of the first opening of the open-ended sleeve to promote the open-ended sleeve remaining securely affixed to the seat portion while the seat portion moves among a lowered position and a raised position;

a second elastic band material that is affixed to at least part of a circumference of the second opening of the open-ended sleeve to promote the open-ended sleeve remaining securely affixed to the seat portion while the seat portion moves among a lowered position and a raised position;

an elastic trim for securing an elastic fabric pocket to the open-ended sleeve with an elastic trim;

the elastic fabric pocket that is attached to the underside of the open-ended sleeve by the elastic trim;

wherein the elastic fabric pocket is configured to hang down from the underside of the seat portion when the seat portion is in the lowered position;

wherein the elastic fabric pocket is further configured to remain affixed to the seat portion when the seat portion moves to the raised position; and a closure mechanism for securing one or more personal items in the elastic fabric pocket;

wherein the open-ended sleeve is an elastic band for affixing the portable, under-seat storage apparatus to the seat portion.

15. The portable, under-seat storage apparatus of claim 14, further comprising:

a pouch that is attached to a seam of the open-ended sleeve;

wherein the pouch is configured to hold the open-ended sleeve in a collapsed position and the elastic fabric pocket in a collapsed position.

16. The portable, under-seat storage apparatus of claim 15, further comprising:

a drawstring closure to secure the open-ended sleeve and the elastic fabric pocket in the pouch.

17. The portable, under-seat storage apparatus of claim 14, further comprising:

when the seat portion of the collapsible chair is in the raised position and when a user of the portable, under-seat storage apparatus is not sitting in the collapsible chair:

the elastic fabric pocket is further configured to remain affixed to the seat portion and to hold the one or more personal items placed in the elastic fabric pocket.

18. The portable, under-seat storage apparatus of claim 14, further comprising:

when the seat portion of the collapsible chair is in a lower position in which a user of the portable, under-seat storage apparatus is sitting in the collapsible chair:

the elastic fabric pocket is further configured to remain affixed to the seat portion and to hold the one or more personal items placed in the elastic fabric pocket.

19. The portable, under-seat storage apparatus of claim 14, wherein the collapsible chair comprises a stadium chair.

20. The portable, under-seat storage apparatus of claim 14, wherein:

a width of the elastic fabric pocket is in accordance with the width of the open-ended sleeve; and a length of the elastic fabric pocket is in accordance with the length of the open-ended sleeve.

21. The portable, under-seat storage apparatus of claim 14, wherein:

a width of the elastic fabric pocket is substantially the same as the width of the open-ended sleeve; and a length of the elastic fabric pocket is substantially the same as the length of the open-ended sleeve.

22. The portable, under-seat storage apparatus of claim 14, wherein:

the elastic trim affixes the open-ended sleeve to the elastic fabric pocket by:

affixing an upper end of the open-ended sleeve to an upper end of the elastic fabric pocket;

affixing a lower end of the open-ended sleeve to a lower end of the elastic fabric pocket;

affixing a right-most side of the open-ended sleeve to a right-most side of the elastic mesh fabric pocket; and affixing a left-most side of the open-ended sleeve to a left-most side of the elastic fabric pocket.

23. The portable, under-seat storage apparatus of claim 14, wherein the open-ended sleeve is configured to expand along one or more dimensions to accommodate a size of the seat portion of the collapsible chair.

24. The portable, under-seat storage apparatus of claim 14, wherein the elastic fabric pocket is configured to expand along one or more dimensions to accommodate a size of the one or more personal items that are placed in the elastic fabric pocket.

25. The portable, under-seat storage apparatus of claim 14, wherein a center of the open-ended sleeve is hollow to promote fitting of the open-ended sleeve around the seat portion of the collapsible chair.

26. The portable, under-seat storage apparatus of claim 14, wherein the open-ended sleeve comprises a first arm structure and a second arm structure, wherein an arm structure comprises a portion of the open-ended sleeve that is secured against a side of the seat portion of the collapsible chair.

27. The portable, under-seat storage apparatus of claim 14, wherein the elastic fabric pocket comprises an open end and a closed end.

* * * * *